US005636968A

United States Patent [19]

Audet et al.

[11] Patent Number: 5,636,968

[45] Date of Patent: Jun. 10, 1997

[54] DEVICE FOR ASSEMBLING A CIRCULAR STAGE OF PIVOTING VANES

[75] Inventors: Jacques R. Audet, Corbeil Essonnes; Jean-Louis Charbonnel, Boissise Le Roi; Gérard G. Miraucourt, Brie Comte Robert; Jean-Claude Prato, Cesson, all of France

[73] Assignee: Societe Nationale D'Etude et de Construction de Moteurs D'Aviation "Snecma", Paris, France

[21] Appl. No.: 508,169

[22] Filed: Jul. 27, 1995

[30] Foreign Application Priority Data

Aug. 10, 1994 [FR] France ..... 94 09867

[51] Int. Cl.[6] ..... F04D 27/00

[52] U.S. Cl. ..... 415/160; 415/162

[58] Field of Search ..... 415/160, 150, 415/151, 155, 162

[56] References Cited

U.S. PATENT DOCUMENTS

| | | | |
|---|---|---|---|
| 3,079,128 | 2/1963 | Burge . | |
| 4,395,195 | 7/1983 | Cosmo et al. . | |
| 4,604,030 | 8/1986 | Naudet | 415/160 |
| 4,792,277 | 12/1988 | Dittberner, Jr. et al. | 415/160 |
| 4,834,613 | 5/1989 | Hansen et al. . | |
| 5,000,659 | 3/1991 | Catte et al. | 415/160 |
| 5,308,226 | 5/1994 | Venkatasubbu et al. | 415/160 |
| 5,466,122 | 11/1995 | Charbonnel et al. | 415/160 |
| 5,492,446 | 2/1996 | Hawkins et al. | 415/160 |

FOREIGN PATENT DOCUMENTS

| | | |
|---|---|---|
| 0 298 894 | 1/1989 | European Pat. Off. . |
| 0 546 935 | 6/1993 | European Pat. Off. . |
| 2 556 410 | 6/1985 | France . |
| 2 152 365 | 8/1972 | Germany . |
| 2 151 309 | 7/1985 | United Kingdom . |

*Primary Examiner*—John T. Kwon

*Attorney, Agent, or Firm*—Oblon, Spivak, McClelland, Maier & Neustadt, P.C.

[57] ABSTRACT

A device for assembling a circular stage of pivoting vanes and composed of a ring for retaining bushes in which the pivots of the vanes rotate. The ring is composed of sectors extending between the pivots and connected together by a circular rail. A further ring separate from the rail or integrated with the latter is engaged in throats of the pivots so as to retain them against an axial movement.

8 Claims, 3 Drawing Sheets

DEVICE FOR ASSEMBLING A CIRCULAR STAGE OF PIVOTING VANES

FIELD OF THE INVENTION

The invention concerns a device for assembling a circular stage of pivoting vanes, often known as variable adjustment vanes and used in a large number of modem turbojet engines, generally at the first stages of the compressor, so as to modify the gas flow characteristics according to the speeds of the turbo engine.

BACKGROUND OF THE INVENTION

The pivoting vanes of a given stage are generally controlled by a common device composed of a control ring and connecting rods joined to the control ring and the various vanes and situated around the vanes outside the stator which delimits the gas flow vein through which the vanes extend; the other extremities of the vanes adjacent to the rotor are joined together by an annular mounting. This mounting was traditionally composed of two rings, one upstream and one downstream which were brought together and assembled by bolts so as to enclose the pivots of the vanes and bushes allowing for tilting. This solution tended to be unfavorable owing to the relatively large number of bolts required for assembling the rings and more particularly the resultant weight.

More recently (namely in the French patent 2 556 410), it was suggested to enclose the bushes and joints between the circle sector locking elements whose mounting forms an entire ring and to complete the device by an annular rail, formed in practice of two assembled portions, along which the sectors are threaded and which retain the elements at the desired disposition, despite the centrifugal and other types of forces. This device is lighter but has the drawback of not having any means to retain the vanes along the axis of their pivot, that is in a radial direction of the turbo engine. Thus, there is a need to provide a more complete mounting of the vanes and this is where the invention proves to be satisfactory. It is characterized by an annular structure provided with apertures and added to the sectors supporting the pivots and to the rail supporting the mounting of the sectors, the apertures being formed in such a way so that portions of the annular structure adjacent to them are engaged on throats of the pivots. Thus, the pivots are guaranteed to be interconnected by the annular structure, the throats remaining within the radius of this structure.

Two main embodiments can be distinguished: the annular structure may be separate from the rail or integrated with it. In the first embodiment, the ring is preferably continuous and the apertures have appropriate shapes so that the pivots can be mounted in the ring. The apertures may be slits opening onto one of the sides of the ring or recesses including widened portions via which the intact portions are able to slide not notched by the throats of the pivots. In the second embodiment, the structure may be provided with a double comer section, each comer being composed of a first core rising up from the rail and a second core, the first cores being parallel and the second cores being cocylindrical and directed towards each other from the first cores.

BRIEF DESCRIPTION OF THE DRAWINGS

There now follows a non-restrictive illustrative description of the invention with reference to the accompanying figures.

DETAILED DESCRIPTION OF THE PREFERRED EMBODIMENTS

Figure 1:
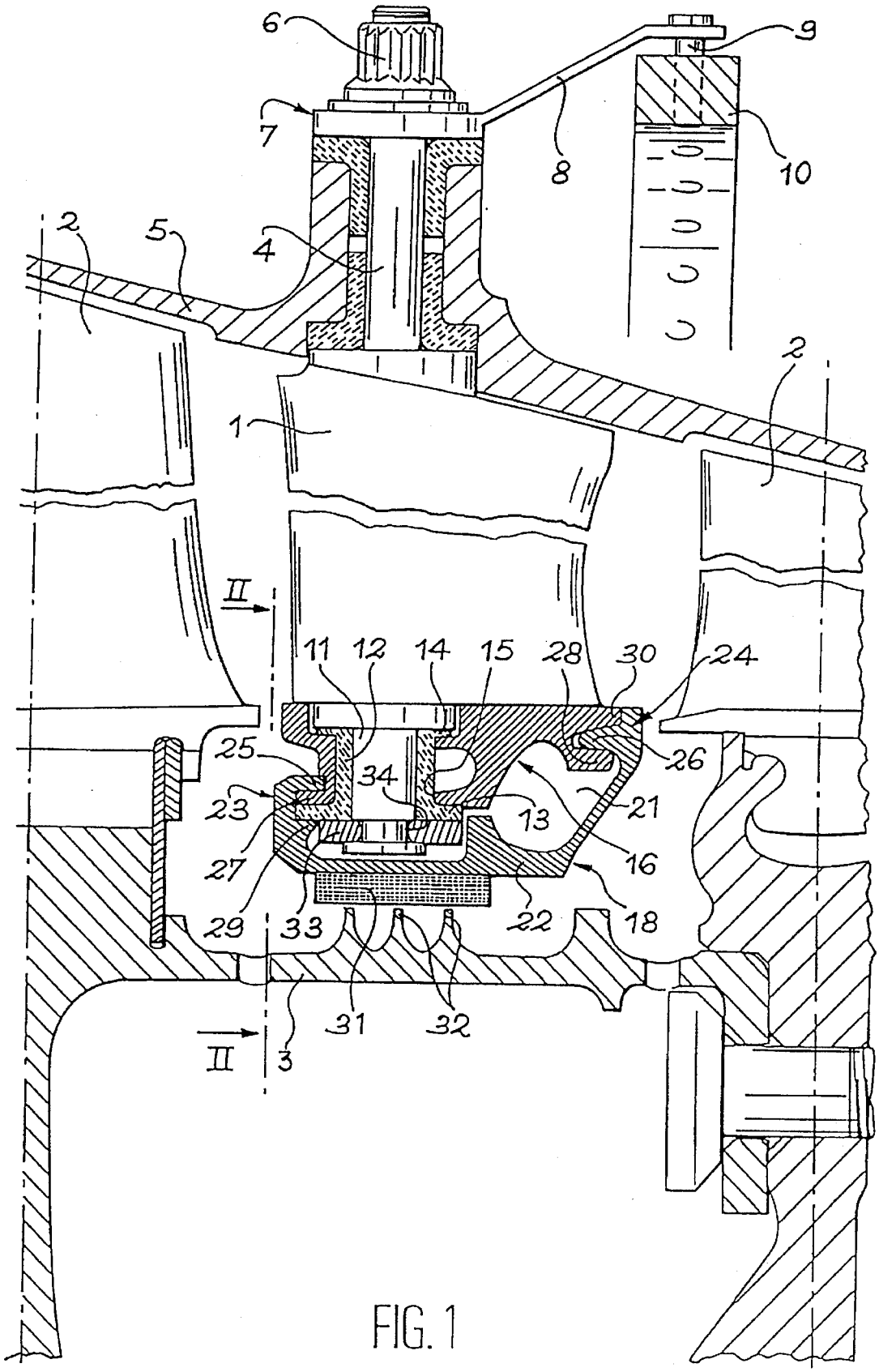
FIG. 1 is a view of a first embodiment of the invention.
Figure 2:
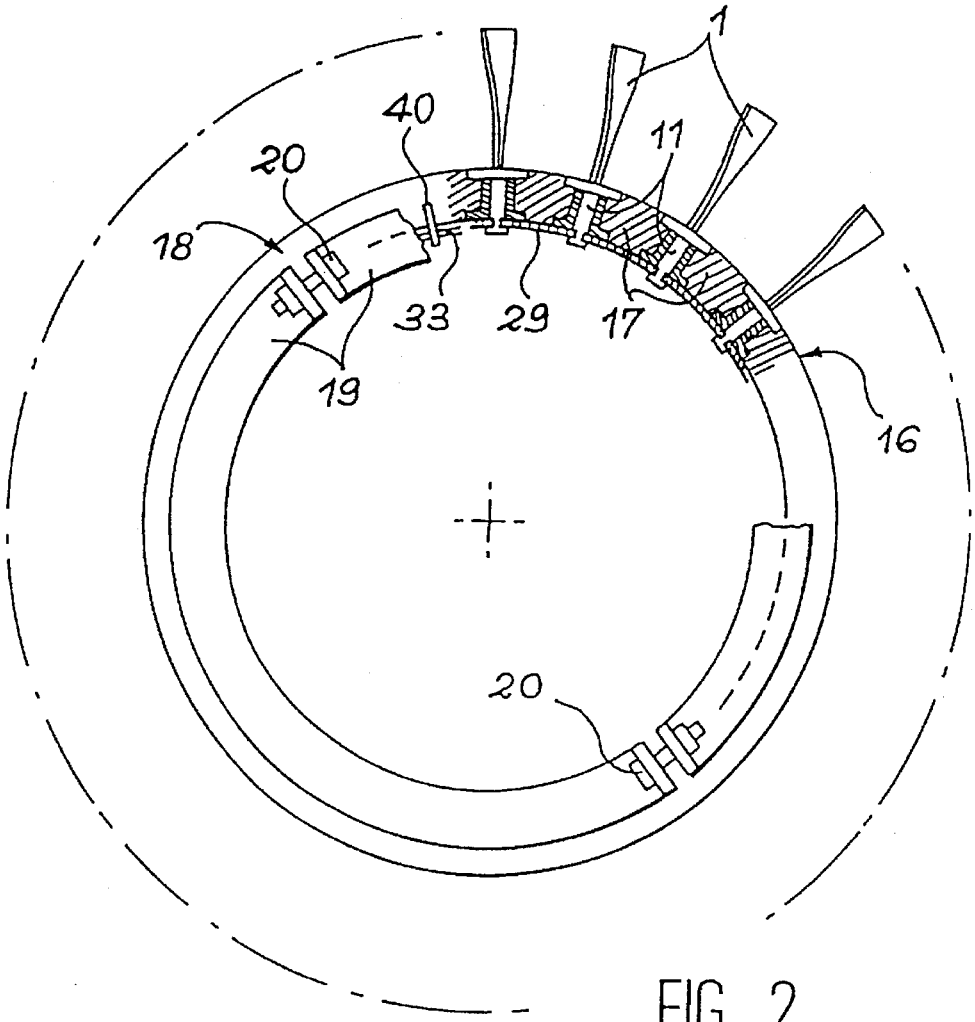
FIG. 2 is a side view of FIG. 1 along the line II—II.

The device constituting the invention and the adjacent portions of the machine are fully represented in FIGS. 1 and 2. The vanes 1 with variable shimming are distributed in circular stages between stages of the same shape with rotor vanes 2 rigidly linked to a rotor 3. The vanes I are allocated to correcting the flow and are ended outside by a control pivot 4 which traverses a stator casing 5 and ends outside the latter via a square or hexagonal head 6 on which a control wrench has been engaged at the end of the control rod 8 whose other end slides through a pivoting shaft end 9 of a control ring 10 whose rotation around the axis of the machine makes the control rods 8 rotate and the vanes 1 of the entire stage.

The vanes 1 are ended at their opposing extremity by a guiding pivot 11 rotating in a bush 12 fitted with circular shoulders 13 and 14 at its two extremities. The bush 12 is engaged in the perforations 15 of a retaining ring 16 composed, as shown on FIG. 2, with sectors 17 ended at their extremities in an angular direction by a perforation half. When the sectors 17 are assembled, the perforation halves are assembled to form the full perforations 15 in which the bushes 12 and pivots 11 are enclosed. The sectors 17 are not directly connected to one another but threaded in a rail 18 composed of two half-rings 19 connected together by bolts 20 at their joining points.

The rail 18 has an approximately trough-shaped section forming a recess 21. It is composed of a bottom 22 of the edges from which two flanks 23 and 24 rise up, each flank having a shoulder 25 or 26 which advances above the bottom 22 and which surrounds a shoulder 27 or 28 respectively outside the sectors 17 so as to enclose them. So as to complete the mounting and render it more rigid, the flank 23 again includes an internal shoulder 29 and the shoulder 27 and small ring 13 are enclosed between the shoulders 25 and 29, and an outer shoulder 30 is disposed on the other side of the sectors 17 so that the shoulder 26 is enclosed between the shoulders 28 and 30 which are parallel.

The bottom 22 bears a wearable material film 31, that is one with easy erosion or wear, on its internal face in front of circular peak-shaped slices which rise up from the rotor 3. It is well known that the differential thermal expansions of the vanes 1 and the rotor 3 mean that the slices 32 touch the easy wear material while the machine is being serviced, rub onto it and wear it down by modeling it to their shape only allowing an extremely small amount of play to exist which almost fully opposes the leaks at this location of the machine.

A ring 33 is sheltered in the recess 21 and engaged in throats or grooves 34 of the pivots 11. The ring 33 is continuous over its entire circumference and thus common to all the pivots 11.

Figure 3:
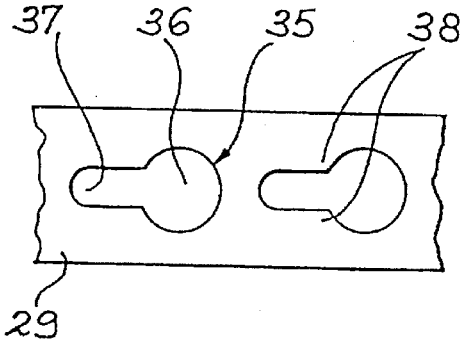
FIGS. 3 and 4 represent two embodiments of the ring.

FIG. 3 represents an embodiment example able to carry out mounting: the ring 33 is fitted with apertures 35 composed of a wide portion 36 with a diameter being larger than that of the pivots 11 and able to be engaged through the ring 33 at this location, and a narrow portion 37 whose width is smaller than the diameter of the pivots 11 but larger than the throat bottom diameter 34. As the narrow 37 and wide 36 portions of each aperture 35 are contiguous and successive on the circumference of the ring 33, a movement of rotation of the ring 33 is able, after having driven the pivots 11 through the wide portions 36 so that the throats 34 reach the top of the ring 33, to make the edges 38 of the narrow portions 37 arrive in the throats 34 so as to therefore retain the vanes 1 in the radial direction of the turbo engine.

Figure 4:
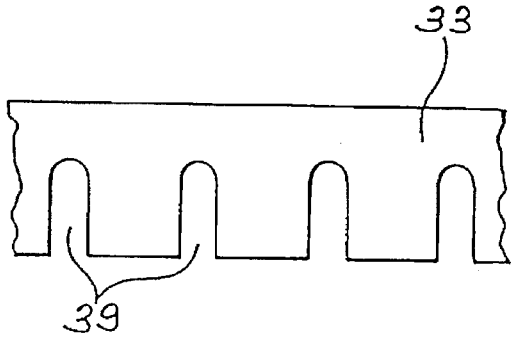

FIG. 4 demonstrates that other embodiments are possible to provide the same retaining effect and that in particular the apertures 35 in the form of recesses at the center of the ring 33 may be replaced by slits 39 whose width is identical to that of the narrow portions 37 and which extend in a lateral direction as far as one of the edges of the ring 33. The ring 33 is then embedded in the throats 34 via a movement in the axis of the machine.

Figure 5:
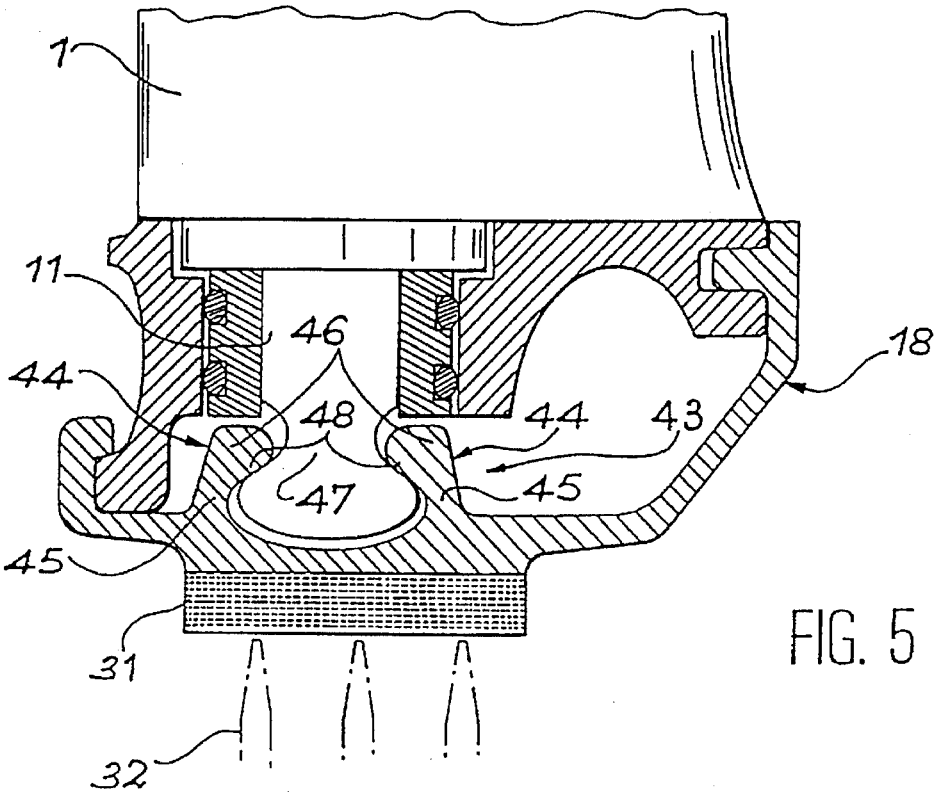
FIGS. 5 and 6 represent two other possible embodiments for the invention.

Other embodiments are also possible. This is why (as shown on FIG. 5) the ring 33 may be replaced by a ring 43 integrated with a rail 18 having the same or a similar shape as previously. It is then composed of a pair of corners or angles 44 almost juxtaposed but separate and composed of a first core or wing 45 connected to the bottom 22 and which rises up to a second core or wing 46. The first cores 45 are parallel to one another and the second cores 46 belonging to a given cylinder are orientated towards one another from the first cores 45 and separated by a circular groove 47 which is a gap with a constant width in which the pivots 11 can be thread via their throat 34. The free and convergent edges 48 of the second cores 46 are thus engaged in the throats 34.

Figure 6:
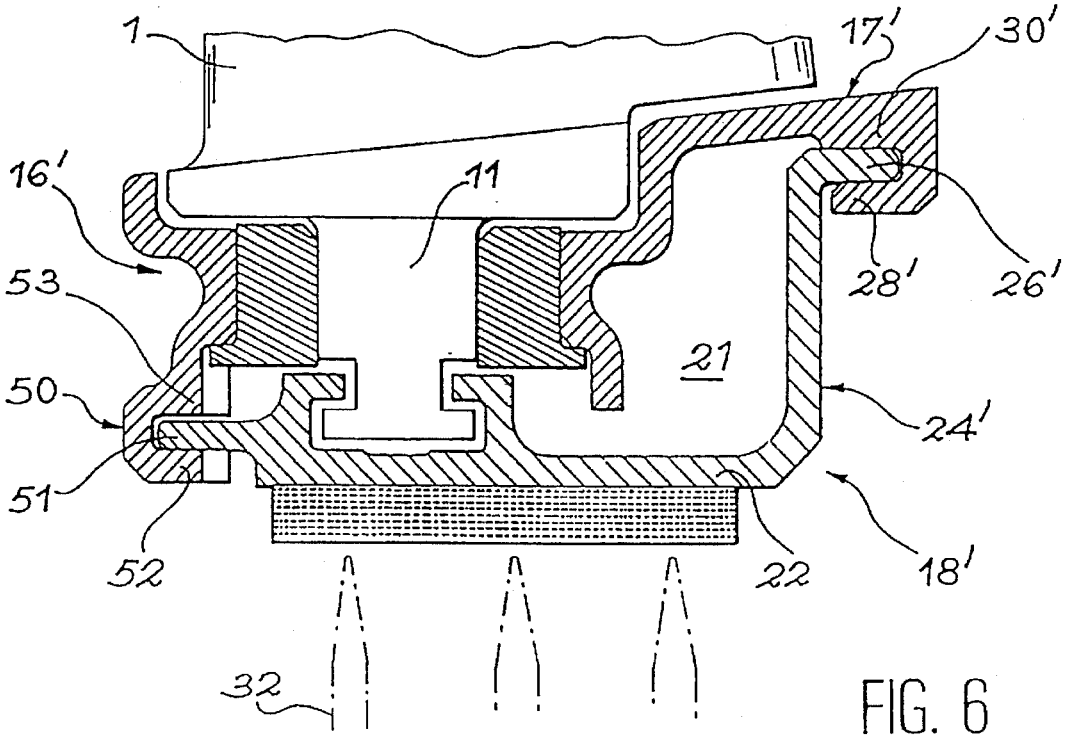

FIG. 6 shows a variant where the rail 18' has been modified: the flank 23 is absent and the other flank 24' is different as its shoulder 26' is orientated towards the outside of the recess 21; the shoulders 28' and 30' of the sectors 17' of the ring 16' are then directed towards the inside of the assembly so as to enclose this shoulder 26'. The flank 23 is replaced by an extension 50 of the sectors 17' at this location so as to retain the joining point with the rail 18' and cover the recess 21. The bottom 22 of the rail 18 is now provided with a shoulder 51 orientated towards the outside of the assembly and engaged between two superimposed shoulders 52 and 53 of the extension 50.

The ring 33 separated from the rail 18 may be guaranteed against any accidental movement during use which could cause the assembly to become dismantled. For example, it is possible to link it to one of the sectors 17 by a screw or a forcibly fixed slug 40.

What is claimed is:

1. A device for assembling a circular stage of vanes that rotates about pivots, the device comprising:

a set of sectors, the sectors being joined in a ring configuration and comprising recesses housing bushes for rotatably supporting the pivots; and an annular rail for retaining the sectors together in the ring configuration;

wherein the pivots comprise circular grooves and the device further comprises an annular structure provided with apertures, portions of the annular structure adjacent to the apertures being engaged in the grooves.

2. A device for assembling a circular stage of pivoting vanes according to claim 1, wherein the annular rail has a hollow cross-section and includes a bottom portion covering the pivots, the annular structure being disposed between the bottom portion and the sectors.

3. A device for assembling a circular stage of pivoting vanes according to claim 2, wherein the bottom portion bears a layer of abradable material belonging to a sealing device.

4. A device for assembling a circular stage of pivoting vanes according to claim 2, wherein the annular structure is integrated with the rail.

5. A device for assembling a circular stage of pivoting vanes according to claim 4, wherein the annular structure has a cross-section comprising two angles, the angles each being composed of a first wing rising from the bottom and a second wing, the first wings being mutually parallel and the second wings being co-cylindrical and directed towards each other from the first wings.

6. A device for assembling a circular stage of pivoting vanes according to claim 1, wherein the annular structure is a continuous ring separate from the rail.

7. A device for assembling a circular stage of pivoting vanes according to claim 6, wherein the apertures are composed of two adjacent portions, the first of said portions being wider than a diameter of the pivots and the second of said portions being narrower than the diameter of the pivots, except at the grooves.

8. A device for assembling a circular stage of pivoting vanes according to claim 6, wherein the apertures are slits opening onto one of the sides of the ring.

* * * * *